US006964291B2

(12) United States Patent
Judkins

(10) Patent No.: US 6,964,291 B2
(45) Date of Patent: Nov. 15, 2005

(54) DOUBLE SHADE HEADRAIL WITH REMOVABLE CORD COLLECTION SPOOLS

(76) Inventor: Ren Judkins, 46 Newgate Rd., Pittsburgh, PA (US) 15202

( * ) Notice: Subject to any disclaimer, the term of this patent is extended or adjusted under 35 U.S.C. 154(b) by 9 days.

(21) Appl. No.: 10/755,647

(22) Filed: Jan. 12, 2004

(65) Prior Publication Data

US 2004/0140060 A1 Jul. 22, 2004

Related U.S. Application Data

(60) Provisional application No. 60/440,004, filed on Jan. 14, 2003.

(51) Int. Cl.[7] ..... E06B 9/322
(52) U.S. Cl. ..... 160/170; 160/84.04
(58) Field of Search ..... 160/170, 171, 160/89, 84.04, 84.05

(56) References Cited

U.S. PATENT DOCUMENTS 5,133,399 A 7/1992 Hiller et al.
5,205,334 A 4/1993 Judkins
5,259,433 A 11/1993 Cloutier
5,328,113 A 7/1994 de Chevron Villette et al.
5,645,118 A 7/1997 Lagarde
5,699,847 A 12/1997 Villette et al.
5,908,062 A * 6/1999 Fun ..... 160/170
6,244,532 B1 * 6/2001 Watanabe ..... 242/399.1
6,786,270 B2 * 9/2004 Wen et al. ..... 160/170
2001/0035269 A1 11/2001 Judkins

FOREIGN PATENT DOCUMENTS

EP 0 380 346 8/1990

* cited by examiner

*Primary Examiner*—Blair M. Johnson
(74) *Attorney, Agent, or Firm*—Buchanan Ingersoll PC

(57) ABSTRACT

A headrail suitable for use with a roller shade or a blind of the type having at least two spaced apart lift cords has a roller attached to the headrail in a manner to permit rotation of the roller and prevent movement of the roller in a longitudinal direction. The outer surface of the roller is free of threads and other projections such that roller shade material can be wrapped about the roller. A plurality of cord collection spools are provided on the roller. The spools can be slid off one end of the roller and may be moveable in a longitudinal direction or fixed to the roller by a set screw or clamp. If fixed to the roller the cord collection spool has a conical shape and an attachment position for a lift cord that is offset in a transverse direction along the roller from the hole in the bottom of the headrail through which a lift cord passes onto the cord collection spool. This headrail can be configured for a double shade and used for a double shade, or for a single a roller shade or for a single shade having lift cords such as a pleated shade.

10 Claims, 3 Drawing Sheets

DOUBLE SHADE HEADRAIL WITH REMOVABLE CORD COLLECTION SPOOLS

CROSS REFERENCE TO RELATED APPLICATION

This application claims priority to U.S. Provisional Patent Application Ser. No. 60/440,004, filed Jan. 14, 2003.

FIELD OF INVENTION

The invention relates to heardrails for double shades.

BACKGROUND OF THE INVENTION

Double shades such as are disclosed in my U.S. Pat. No. 5,205,334 have a headrail that holds two independently operable shades. One shade is a roller shade in which shade material is wound on a roller within the headrail. The second shade is a pleated or cellular shade that is attached to the bottom of the headrail. Pleated and cellular shades have lift cords that extend from the bottomrail into the headrail. In some shades the cords are routed through a cord lock and extend out one end of the headrail. In other shades the lift cords are collected on an axle within the headrail. In the double shade disclosed in U.S. Pat. No. 5,205,334 the lift cords pass through a cord lock. This is typical of double shades.

Double shades as well as most other window coverings that have a headrail are usually assembled for particular installations rather than being stock items. Fabricators who sell double shades usually also sell pleated shades, cellular shades and roman shades. These shades have lift cords that either pass through a cord lock or are collected on spools or an axle within the headrail. In recent years the industry has been concerned about child safety and limiting the number of cords that are accessible in a window covering product. Therefore, window coverings that collect lift cords in the headrail are preferred from a child safety perspective. Prior to the present invention, the headrails used for double shades could not be used for single, pleated or cellular shades in which the lift cords were collected in the headrail. Instead, fabricators were required to maintain one headrail system for double shades and a different headrail system for single shades in which the lift cords were collected in the headrail. There is a need for a roller with removable cord collection spools that can be used in a headrail for double shades. Such a system would enable fabricators to maintain one headrail system that could be used for double shades, pleated shades, cellular shades and roman shades.

A typical double shade is shown in FIGS. 1, 2 and 3. A headrail 1 supports both a pleated shade 8 and a roller shade 12. End caps 2 and 3 are provided at either end of the headrail and a roller shade mechanism is mounted within the headrail. The headrail is attached to a wall or window frame 15 shown in chainline in FIG. 3. A wall mount may be made through bracket 11 or end caps 2 or 3. A ceiling or wall mount is made through bracket 11. The roller shade 12 is wound around roller 14 which rides on brackets that are preferably built into the end caps 2 and 3. The pleated shade 8 is mounted to the bottom 18 of the headrail 1. If desired, the front face 4 of the headrail can be extended by leg 32 as shown in FIG. 3 to obscure all or a portion of the fabric stack. The pleated shade material in the double shade of FIGS. 1 and 3 has tabs 9 which extend from the rear pleats of fabric 8. Each lift cord 7 passes through holes in the tabs 9 to bottom rail 6 of the pleated shade. The opposite end of each cord 7 extends through a cord lock 30 as shown in FIG. 3.

In U.S. Pat. No. 5,791,393 I disclose a shade operator which enables a roller shade to be operated by a single ribbon. This shade operator can be used in a double shade of the type shown in FIGS. 1 through 3. Consequently, if a cord collection spool could be substituted for the roller shade then the shade operator could operate a single pleated, cellular or roman shade attached to a double shade headrail.

Most cord collection spools for pleated, cellular and roman shades utilize a single axle about ¼ inch in diameter. The cord may be collected directly on the axle as disclosed in U.S. Pat. No. 5,194,660. Or, the cord may be collected on a spool attached to the axle such as is disclosed in my U.S. Pat. No. 6,644,372 and in U.S. Pat. No. 5,699,847. When the lift cords are collected on an axle or spools in the headrail it is necessary to assure that as the cords are wound and unwound so that each turn of the cord is adjacent the previous turn. If the turns of one lift cord overlap while the turns of another lift cord do not, the bottom of the shade will be tilted as the shade is raised and lowered. Most cord collection systems overcome this problem by moving the axle, moving the spools on the axle or moving a cord guide on or adjacent the axle, left or right as the axle turns. Such movement prevents overlap of the lift cords as they are wound and unwound.

Any roller which is used in a roller shade cannot move from left to right, or right to left as the roller rotates. Such transverse movement would impede the rolling and unrolling of the shade material. Since the roller cannot move transversely, it is necessary that spools be used to collect lift cords on a roller.

Several years ago the French company, Somfy, made a pleated shade in which each lift cord was wound on a spool that was fixed to a shade roller. The spools had a collar at either end and their positions on the roller could not be adjusted. Consequently, when the lift cords were wound onto the spools, the turns of each lift cord could overlap. This system was not in the marketplace very long. Furthermore, because the spools were firmly attached to the roller, one could not wind shade material on the roller. If one wanted to use the headrail for a roller shade, the roller with spools had to be replaced with a standard shade roller.

Somfy was able to design a system in which lift cords are collected on an axle or tube that did not move transversely. This system has a drum with a collar or shoulder for each lift cord and is disclosed in U.S. Pat. No. 5,328,113. A cord guide directs the lift cord onto a drum. The cord guide assures that the lift cord is initially collected on the drum adjacent the shoulder. Each turn of the cord pushes the previous turns toward and eventually onto the axle. Like the cord collection spools in other systems, the drums create projections along the length of the axle. Therefore, a roller shade cannot be wound about the axle in this system without being wrinkled or damaged.

Consequently, there is a need for a cord collection system having a roller that can be used for a roller shade. This roller must be able to receive spools that can collect lift cords while avoiding the cord overlap problem. These spools must be removable from the roller. There can be no projections from the surface of the roller after the spools are removed which would cause wrinkling of shade material wound on the roller.

SUMMARY OF THE INVENTION

I provide a headrail suitable for use with a roller shade or a blind of the type having at least two spaced apart lift cords. A roller is attached to the headrail in a manner to permit rotation of the roller and prevent movement of the roller in a transverse or longitudinal direction. The outer surface of the roller is free of threads and other projections such that roller shade material can be wrapped about the roller without wrinkling. A plurality of cord collection spools are provided on the roller. The spools can be slid off one end of the roller and may be moveable in a longitudinal direction or fixed to the roller by a set screw or clamp. If fixed to the roller the cord collection spool has a conical shape and an attachment position for a lift cord that is offset in a transverse direction along the roller from the hole in the bottom of the headrail through which a lift cord passes onto the cord collection spool. This headrail can be configured for use in a double shade. In addition to being used in a double shade, that same headrail can be used for a single roller shade or for a single shade having lift cords such as a pleated shade.

Other objects and advantages of the my headrail and cord collector will become apparent from certain present preferred embodiments therein shown in the drawings.

DESCRIPTION OF THE PREFERRED EMBODIMENTS

Figure 1:
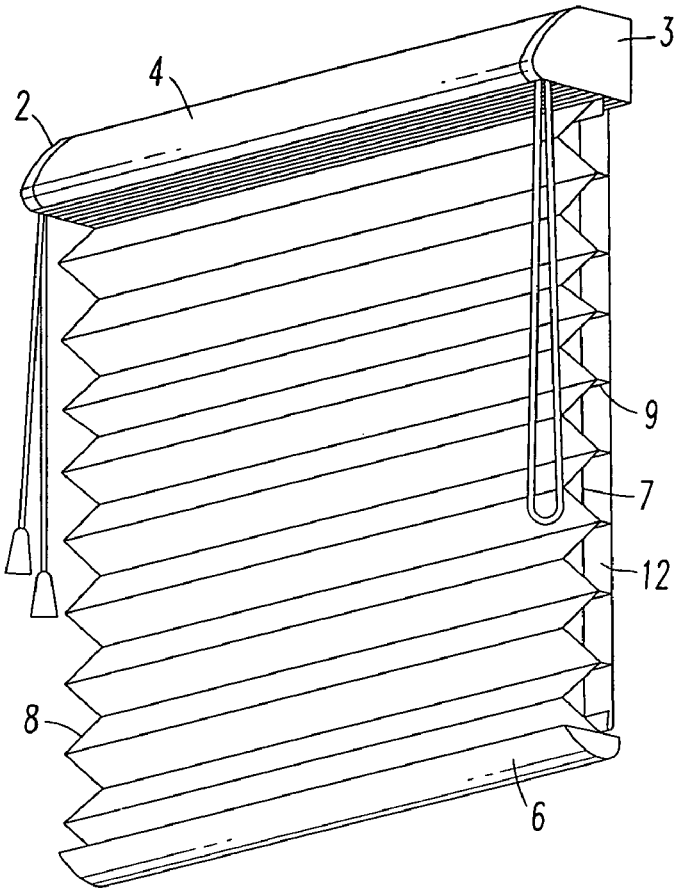
FIG. 1 PRIOR ART
FIG. 1 is a perspective view of a prior art double shade.
Figure 2:
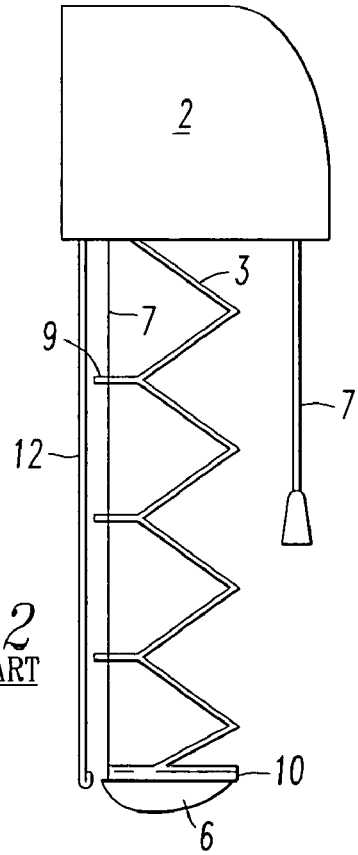
FIG. 2 PRIOR ART
FIG. 2 is a side view of the double shade shown in FIG. 1.
Figure 3:
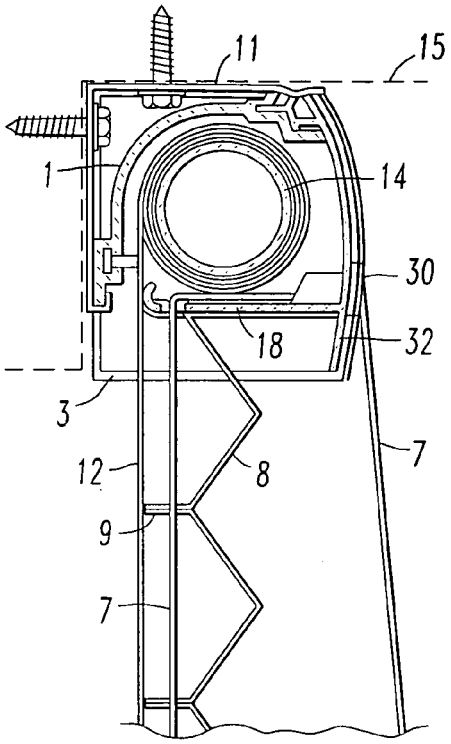
FIG.3 PRIOR ART
FIG. 3 is an end view similar to FIG. 2 with the end cap of the headrail removed and sectioned to easily distinguish portions of the headrail.
Figure 5:
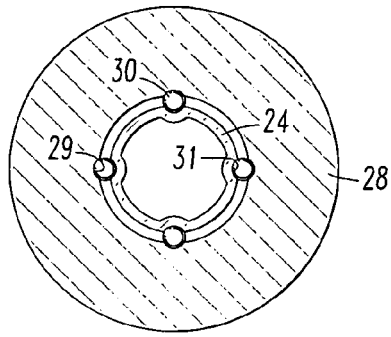
FIG. 5 is a sectional view taken along the line 5—5 of FIG. 4.
Figure 4:
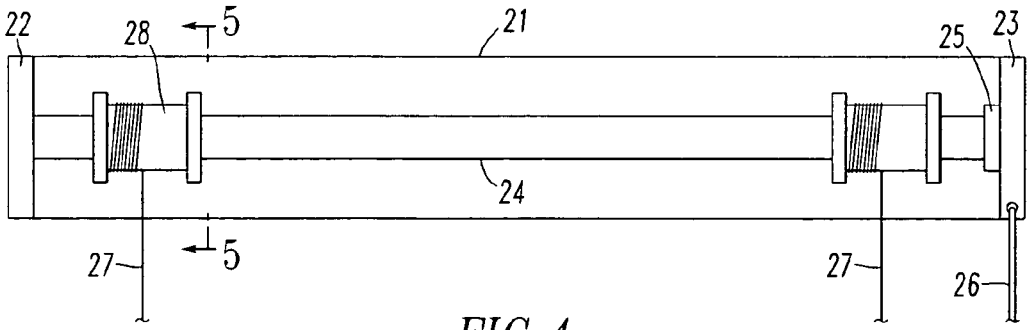
FIG. 4 is a front view of a first present preferred embodiment of my headrail and cord collector with the front wall of the headrail removed.

I provide a cord collection system for use in a double shade headrail that uses a roller similar to that used for a roller shade. As can be seen most clearly in FIG. 4, this roller 24 is attached to the headrail 21 in the same manner as a roller shade. In this embodiment there is a shade operator 25 at one end of the headrail. If desired the shade operator need not be used and the roller could be operated by a conventional loop cord drive or motor. The roller 24 extends from end cap 22 to shade operator 25 attached to end cap 23. A ribbon 26, which controls the shade operator, exits through end cap 23. One spool 28 is provided for each lift cord. Each spool is attached to the roller in a manner that permits the spool to travel along the roller. As shown in FIG. 5, the central bore through the spool has a series of recesses 29. Mating recesses or flutes 31 are provided in the roller 24. A ball bearing is captured within each recess 29 and flute 31 allowing the spool to travel along the roller and to rotate with the roller. The flutes preferably extend to at least one end of the roller enabling the spools to be easily removed from the roller. In the embodiment shown in FIG. 5, four flutes 31 are provided and a bearing is provided in each flute and recess. One could provide more or fewer flutes than shown in FIG. 5. If multiple flutes are provided it should not be necessary to provide a bearing in every flute. After the spools have been removed the roller can be used in a roller shade because there are no projections on the roller that could cause shade material wound on the roller to wrinkle or that would impede collection of roller shade material. Although I prefer that there be no outward projections on the surface of the roller, the roller could be deformed outward to form ribs along lines corresponding to flutes 31 and still be acceptable for use with some shade materials. If such ribs are provided it would not be necessary to use the ball bearing. Instead, the ribs would fit within recesses 29. When the roller is turned, spools 28 will rotate with the roller collecting or playing out the lift cords. As each lift cord is collected each turn of the lift cord will lay adjacent the previous turn as the spool moves transversely on the roller. This transverse movement prevents overlap of the lift cords. The roller 24 in the embodiment of FIGS. 4 and 5 is tubular and has a circular cross-section. However, a solid roller could be used. Moreover, those skilled in the art will recognize that other cross-sectional shapes that enable the spool to rotate with the roller and slide along the roller could be used. One could provide an oval roller or a multi-sided roller having a cross section that is close to a circle, such as a hexagon or octagon. Spools 28 are cylindrical and have collars at both ends. Either or both collars may be eliminated. The spools could be conical.

Figure 6:
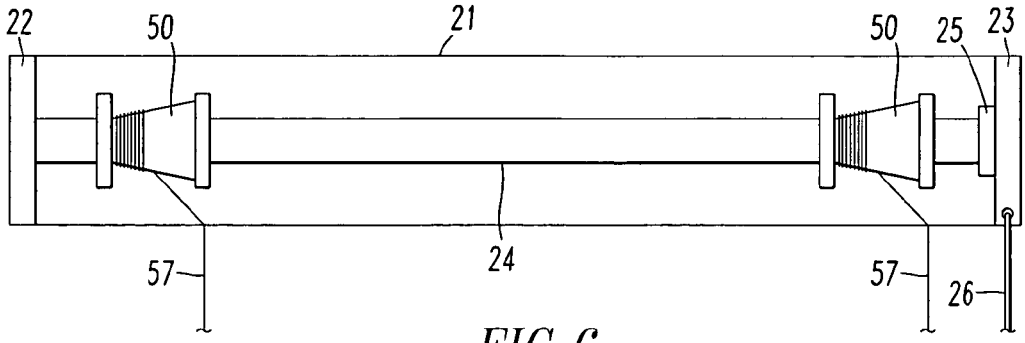
FIG. 6 is a front view similar to FIG. 4 of a second present preferred embodiment of my headrail and cord collector.
Figure 7:
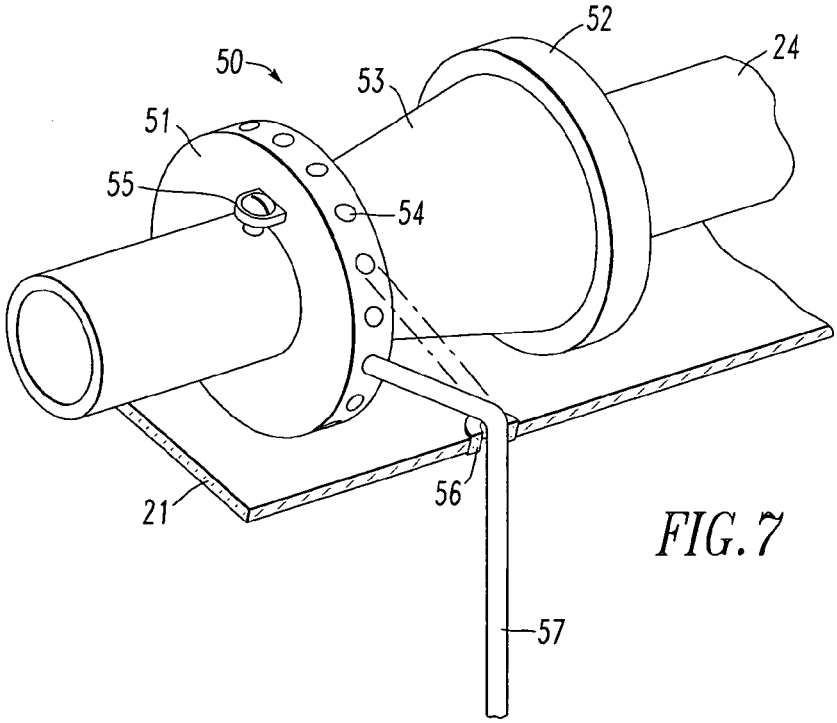
FIG. 7 is a perspective view of one of the cord collection spools on a portion of the roller in the embodiment of FIG. 6.

In another cord collection system shown in FIGS. 6 and 7 a roller 24 is attached to the headrail 21, as in the previous embodiment. Spool 50 is fixed to the roller 24 by a set screw 55. One could use a clamp or other attachment member to fix the spool on the roller. The spool has a conical body 53 with rims or collars 51 and 52. The lift cord enters the bottom of the headrail 21 through eyelet 56 and is connected to a post or a slot 54 on rim 51. The attachment portion of the lift cord is offset in a transverse direction along the roller from the eyelet 56 and the opposite end of the spool is above the eyelet. Consequently, the cord is at an angle relative to the cord collection spool 50 as the cord is collected onto the spool. The angle assures that the turns of the lift cord will stack side-by-side and not overlap. Several slots, posts or other cord connection positions 54 are provided along the rim. This enables the installer to easily adjust the length of the cord by moving the end of the cord to a different attachment position as shown in dotted line in FIG. 7. Other types of adjustment systems in which the spool 50 is rotated relative to the roller 24 could be used to adjust the length of the cord. One such system might involve a crown gear fixed to the axle and a similar structure on the end of the spool. To rotate the spool relative to the axle, the spool is disengaged from the crown gear rotated a desired amount and engaged again with the crown gear.

Although I have described and illustrated certain present preferred embodiments of my headrail and cord collector, it should be distinctly understood that the invention is not limited thereto but may be variously embodied within the scope of the following claims.

I claim:

1. A headrail suitable for use with a roller shade or a blind of the type having at least two spaced apart lift cords, the headrail comprised of:

a. an elongated body having a bottom, a front side, a first end and a second end, the bottom and the front side attached to and extending between the first end and the second end, the bottom having a selected number of holes through which a lift cord may pass;

b. a roller attached to the first end and the second end of the elongated body in a manner to permit rotation of the roller and prevent movement of the roller in a longitudinal direction, the roller having a longitudinal flute and an outer surface free of threads and projections that would cause wrinkling of roller shade material wrapped about the roller; and c. a plurality of cord collection spools, each cord collection spool having an attachment position for a lift cord and a longitudinal bore through which the roller passes, the roller and the spools being sized and configured so that:

rotation of the roller will rotate the cord collection spools, the cord collection spools are moveable relative to the roller in a longitudinal direction, the cord collection spools can be slid off at least one end of the roller; and each of the plurality of cord collection spools has a recess adjacent the longitudinal bore of that cord collection spool and further comprising a ball bearing for each cord collection spool, each ball bearing positioned within the recess of a cord collection spool and also positioned within the longitudinal flute;

wherein each cord collection spool is positioned adjacent to one hole of the selected number of holes in the bottom of the headrail.

2. The headrail of claim 1 wherein the cross-section of the roller is a polygon shape.

3. The headrail of claim 1 wherein the roller has a plurality of longitudinal flutes and each of the plurality of cord collection spools has a plurality of recesses adjacent the longitudinal bore of that cord collection spool and further comprising a ball bearing positioned within each recess of a cord collection spool and each ball bearing also positioned within one of the plurality of longitudinal flutes.

4. The headrail of claim 1 wherein each of the cord collection spools is conical.

5. The headrail of claim 1 wherein each cord collection spool has a plurality of attachments positions for a lift cord each position comprised of a post on the cord collection spool to which a lift cord can be attached.

6. The headrail of claim 1 wherein each cord collection spool has a plurality of attachments positions for a lift cord each position comprised of a slot in the cord collection spool to which a lift cord can be attached.

7. In an improved headrail for a double layer shade of the type in which a panel of pleated material can be attached to the bottom of the headrail, the bottom having a selected number of holes through which a lift cord may pass, and a roller shade can be positioned within the headrail wherein the improvement comprises:

a. a roller within the headrail and attached to the headrail in a manner to permit rotation of the roller and prevent movement of the roller in a longitudinal direction, the roller having a longitudinal flute and an outer surface free of threads and projections that would cause wrinkling of shade material wrapped about the roller; and b. a plurality of cord collection spools, each cord collection spool having an attachment position for a lift cord and a longitudinal bore through which the roller passes; the roller and the spools being sized and configured so that:

rotation of the roller will rotate the cord collection spools, the cord collection spools can be slid off at least one end of the roller; and each of the plurality of cord collection spools has a recess adjacent the longitudinal bore of that cord collection spool and further comprising a ball bearing for each cord collection spool, each ball bearing positioned within the recess of a cord collection spool and also positioned within the longitudinal flute;

wherein each cord collection spool is positioned adjacent to one hole of the selected number of holes in the bottom of the headrail.

8. The improved headrail of claim 7 wherein the cross-section of the roller is a polygon shape.

9. The improved headrail of claim 7 wherein the roller has a plurality of longitudinal flutes and each of the plurality of cord collection spools has a plurality of recesses adjacent the longitudinal bore of that cord collection spool and further comprising a ball bearing positioned within each recess of a cord collection spool and each ball bearing also positioned within one of the plurality of longitudinal flutes.

10. The improved headrail of claim 7 wherein each of the cord collection spools is conical.

* * * * *